US009046297B2

(12) United States Patent
Stocker

(10) Patent No.: US 9,046,297 B2
(45) Date of Patent: Jun. 2, 2015

(54) REFRIGERATOR AND/OR FREEZER UNIT

(75) Inventor: Richard Stocker, Lienz (AT)

(73) Assignee: Liebherr-Hausgeräte Lienz GmbH, Lienz (AT)

( * ) Notice: Subject to any disclaimer, the term of this patent is extended or adjusted under 35 U.S.C. 154(b) by 0 days.

(21) Appl. No.: 13/445,252

(22) Filed: Apr. 12, 2012

(65) Prior Publication Data

US 2012/0262047 A1 Oct. 18, 2012

(30) Foreign Application Priority Data

Apr. 13, 2011 (DE) ..... 10 2011 016 915
Apr. 29, 2011 (DE) ..... 10 2011 100 042

(51) Int. Cl.
*A47B 96/04* (2006.01)
*F25D 23/08* (2006.01)

(52) U.S. Cl.
CPC ..... *F25D 23/087* (2013.01); *F25D 2323/021* (2013.01)

(58) Field of Classification Search
CPC F25D 23/087; F25D 23/082; F25D 2323/021
USPC ..... 312/405, 296; 49/313, 483.1; 16/277
See application file for complete search history.

(56) References Cited

U.S. PATENT DOCUMENTS

| | | | | | |
|---|---|---|---|---|---|
| 1,918,911 | A | | 7/1933 | Hull | |
| 2,692,809 | A | * | 10/1954 | Kesling | 312/405 |
| 2,723,896 | A | * | 11/1955 | Wurtz | 312/296 |
| 2,767,040 | A | * | 10/1956 | Kesling | 312/296 |
| 2,859,495 | A | * | 11/1958 | Roberts | 49/480.1 |
| 3,077,644 | A | * | 2/1963 | Kesling | 49/366 |
| 3,248,159 | A | * | 4/1966 | Hall | 312/296 |
| 4,428,153 | A | * | 1/1984 | Klinger et al. | 49/366 |
| 5,816,080 | A | * | 10/1998 | Jeziorowski | 62/441 |
| 7,178,293 | B2 | * | 2/2007 | Kim | 49/478.1 |
| 2007/0125002 | A1 | * | 6/2007 | Linkmeyer et al. | 49/368 |

FOREIGN PATENT DOCUMENTS

| | | |
|---|---|---|
| DE | 1709409 | 10/1955 |
| JP | 2005-283116 | 10/2005 |

* cited by examiner

*Primary Examiner* — Daniel J Troy
*Assistant Examiner* — Timothy M Ayres
(74) *Attorney, Agent, or Firm* — Dilworth & Barrese, LLP

(57) ABSTRACT

The present invention relates to a refrigerator/freezer having doors in turn having seals, with the seals in the closed state of the doors sealing the region between the doors, the seal of at least one door movable into a position at least regionally having larger spacing from the seal of the other door than in the closed position, at least one cam moving on opening and closing the door, and the cam contacting both the door and the seal to move the seal from the first to second position when the door is opened.

14 Claims, 4 Drawing Sheets

REFRIGERATOR AND/OR FREEZER UNIT

BACKGROUND OF THE INVENTION

The present invention relates to a refrigerator unit and/or a freezer unit having at least one carcass which bounds at least one refrigerated inner space as well as having at least one first and one second door which open in opposite directions, which are pivotally connected to the carcass and by means of which the inner space can be closed, wherein the doors are each designed with at least one seal, with the seals being arranged in a first position they adopt in the closed state of the doors such that they seal the region between the doors.

Such refrigerator units and/or freezer units are known as so-called French-door units. In this unit, the named seals have the object of sealing the region between the two doors opening in opposite directions. Furthermore, seals are usually provided which seal the region between the carcass and the door.

In the closed state of both doors, the seals located between the doors usually contact one another such that the desired sealing function is achieved or a heat input into the refrigerated inner space through a region between the doors is largely or completely prevented.

A problem with such units is that a rubbing of the seals on one another may occur under certain circumstances on the opening of a door and on the closing of a door which makes the opening and closing of the door more difficult, on the one hand, and is unwanted, on the other hand, to the extent that it can have a negative effect on the service life of the seals. It is thus fundamental that the named door seals take over the desired sealing function between the doors in the closed state of the doors, but, as soon as a door is opened or closed, may not impede this closing procedure or opening procedure, where possible. This would in particular have disadvantages in the use of self-closing systems since these do not have any great closing forces so that it is possible under certain circumstances that a door does not close properly.

SUMMARY OF THE INVENTION

It is thus the underlying object of the present invention to further develop a refrigerator unit and/or a freezer unit of the initially named kind such that an opening and closing of the doors is ensured which is as easy as possible.

This object is achieved by a refrigerator unit and/or a freezer unit having the features herein.

Provision is accordingly made that the seal of at least one door is movable into a second position in which it at least regionally has a larger spacing from the seal of the other door than in the first position of the seals. A cam is furthermore provided which is arranged such that it is moved on the opening and closing of the door. This cam is connected both to the door and to the seal so that the seal is moved from its first position into its second position when the door is opened, starting from the closed position. If the door reaches its closed position, the seal is preferably moved by the cam from the second position into the first position.

The cam is thus arranged such that it is moved when at least one of the doors of the unit is opened from its closed position or is moved from an open position into the closed position.

This cam thus undergoes a movement which it transmits in a suitable manner to the respective door seal. In this respect, the cam and the seal are preferably connected to one another so that, on the reaching of the closed position of the doors, the cam moves the seal into its first position in which it is sealingly connected to the seal of the other door. If one or both of the doors is opened, starting from this position, a movement of the cam(s) and thus also a movement of the seal(s) arises directly at the start of the opening procedure or at least from a specific opening angle of the door onward such that the seal(s) is/are moved, starting from their first position, into a second position in which they have a larger spacing from one another than in the state of two closed doors.

The cam correspondingly has the effect that at least one seal of the door is moved away from the other seal if at least one door is opened.

Provision is preferably made that the seals and cams of both doors are moved if, starting from the closed position of both doors, one or both doors are opened.

It is possible in this manner to open and close a door of the unit with a small exertion of force. It is additionally ensured that there is no friction, or only a little friction, between the seals when a door is opened and closed.

Provision is preferably made that the seal is arranged such that it can be pivoted about an axis. It is thus conceivable, for example, that a mount is provided at the door or at a door section in which the seal is received in a region, and indeed such that it is received pivotably and/or rotatably in this mount.

Provision is furthermore preferably made that the cam is arranged such that it can be pivoted about an axis. It is thus possible that the cam is also arranged pivotably and/or rotatably. The cam carries out this pivot movement when, starting from the closed position of both doors, one door or both doors is/are opened or closed. The pivot movement of the cam is transmitted to the seal due to the connection between the cam and the seal such that said seal likewise carries out a pivot movement by which the seal is moved into its second position, i.e. into a parked position, on the opening of the door.

Provision is preferably made that the axis about which the seal is pivotable and/or the axis about which the cam is pivotable is variable in its position. A door gap between the doors of a variable size can be covered by such a variable pivot point. It is, for example, conceivable to cover a door gap which lies in the range between 6 and 9 mm, optionally +1 mm stroke of the seal itself.

It is conceivable in a further embodiment of the invention that the cam is fixedly connected to the seal. Provision is furthermore preferably made in this respect that the cam and the seal have a common pivot point, that is are pivotable and/or rotatably about a common axis.

Provision is made in a further embodiment of the invention that the cam is located in its first position when the door is closed and is located in its second position when the door is opened, starting from this position. Provision can furthermore be made that the cam and the seal are connected to one another such that the cam moves the seal from its first position into its second position when the cam is in turn moved from its first position into its second position.

Provision can generally be made that the cam is arranged such that it at least projects beyond the end side of the door in its second position and/or its contact region is at least moved further away from the door in its second position than in its first position.

The cam can have at least one cam section at which the cam is in contact with a further element, preferably with the cam of the other door, in the closed state of the doors. On the opening of the door, the cam leaves its contact position from a certain opening angle onward, that means that the contact section is then no longer connected to a further element such as to the contact section of the cam of the other door. From this time onward, the cam, preferably the cams and seals of both doors, is/are in its/their second position(s).

Provision is made in a further embodiment of the invention that the axis about which the cam is pivotable is located between the contact section of the cam and the region in which the cam is in contact with the seal.

In a further embodiment of the invention, at least one spring is provided which exerts a force onto the cam and/or directly onto the seal. This spring can be arranged at the door or at a door section, on the one hand, and can cooperate with the cam, on the other hand. The spring is preferably arranged such that the cam is acted on by a force in the direction of its second position.

BRIEF DESCRIPTION OF THE DRAWINGS

Further details and advantages of the invention will be explained in more detail with reference to an embodiment shown in the drawing. There are shown.

DESCRIPTION OF THE PREFERRED EMBODIMENTS

Figure 1:
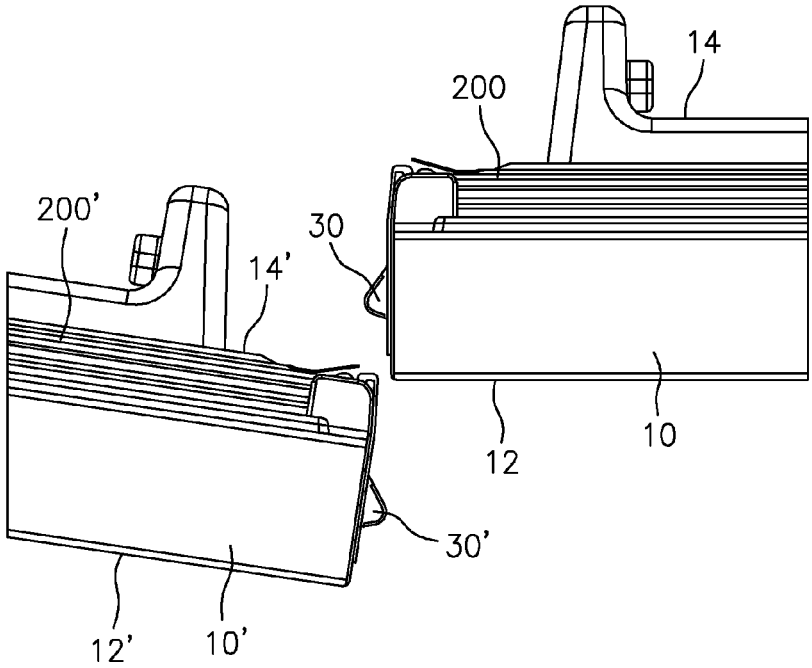
FIG. 1: a plan view of the mutually facing regions of two doors of a French door unit, with one of the doors being slightly opened.

FIG. 1 shows two doors of a French door unit which can be opened in opposite directions to one another having the reference numerals 10, 10'. The doors are each pivotally connected to the carcass of the unit at their side regions, not shown.

As can furthermore be seen from FIG. 1, the doors each comprise an outer door or an outer region 12, 12', for example of metal or sheet metal, and an inner door or an inner region 14, 14'. One or more door pockets can, for example, be fastened to this inner region 14, 14'.

Peripheral magnetic door seals are marked by the reference numerals 200, 200' which each ensure a sealing connection between the door and the carcass.

In the mutually facing regions of the doors 10, 10', they are designed with one or more respective cams, preferably with two or more cams 30, 30', spaced apart in the vertical direction of the doors. As can be seen from FIG. 1, the cams 30, 30' project beyond the mutually facing end faces of the respective doors 10, 10', As can in particular be seen from FIG. 3, the cams 30, 30' are pivotably arranged at the door. The corresponding pivot axis of the cam 30 is marked by the reference numeral 32 in FIG. 3. The cam 30 furthermore has the contact section 34 which can be seen from FIG. 1 and with which the cam 30 comes into connection with a further element, preferably with the cam 30', of the respective other door 10' on a movement of the door into its closed position from the falling below of a specific opening angle onward.

Figure 3:
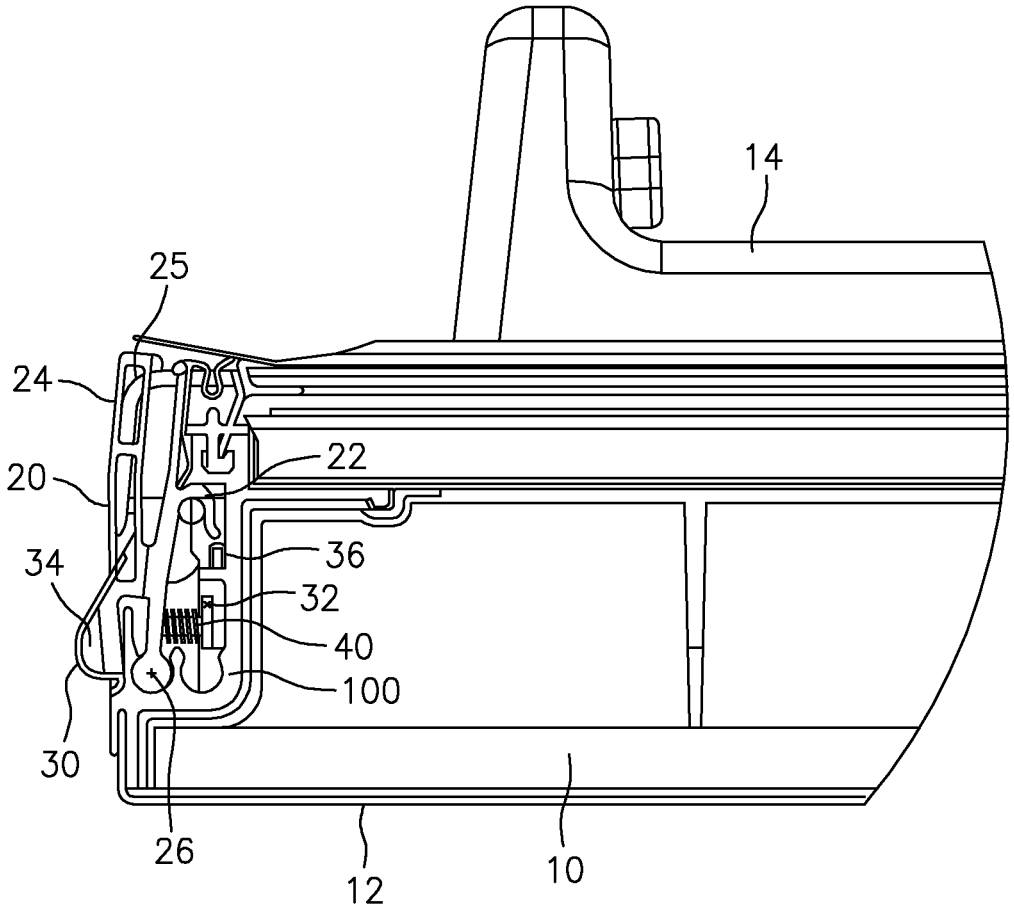
FIG. 3: a sectional view through a door of a French door unit in which the seal is located in its second position.
Figure 4:
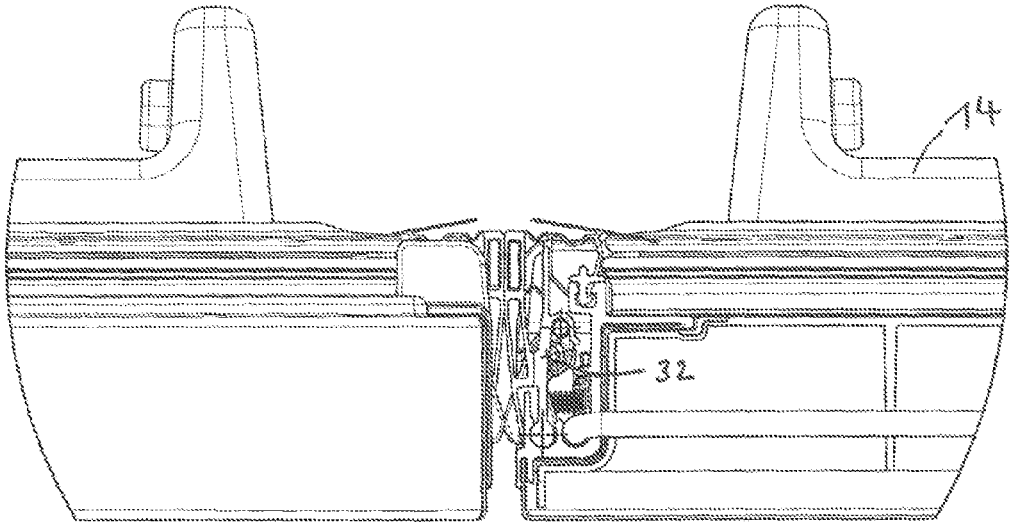
FIG. 4: a view of the doors in accordance with FIG. 1 in a closed state of both doors, with one door being shown in a sectional view, illustrating a variable axis.
Figure 5:
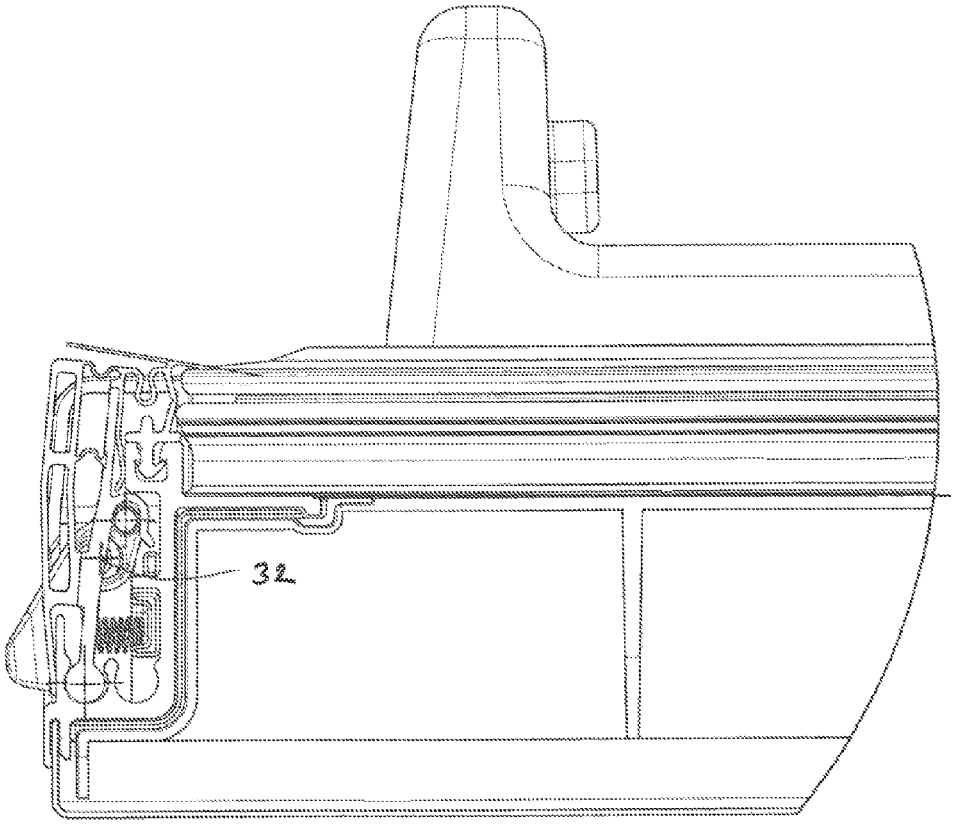
FIG. 5: a view through a door of a French door unit in which the seal is located in its second position, illustrating a variable axis.

FIG. 3 shows the door 10 of a French door unit whose other door 10' is open.

A fastening section, for example a bolt or the like of the cam 30, is marked by the reference numeral 36 which, as can be seen from FIG. 3, is received in a mount region 22 of the seal 20. This section 36 of the cam 30 thus equally serves as a driver and has the effect that the seal 20 is moved when the cam 30 in turn undergoes a movement.

The seal 20 of one or both doors 10, 10' is preferably designed as an extruded section and has a softer part and a part harder with respect thereto. The softer part of the seal 20 is marked by the reference numeral 24 and preferably serves as a sealing part which forms a sealing connection with the seal 20' of the other door. In this part of the seal, at least one chamber 25 can also be arranged in which a magnet can be located which, in interaction with the correspondingly formed seal 20' of the other door 10' attracts it and thus ensures a sealing connection between the doors.

The part of the seal 20 which is harder with respect thereto is marked by the reference numeral 26 and forms a pivot support of the seal 20 which is likewise marked by the reference numeral 26 in FIG. 3. The seal 20 is thus rotatably supported about the axis 26. The mount 22 of the seal 20 can also be designed as a harder part of the seal 20 since it has to ensure that the seal 20 follows the movement of the cam 30.

The door 10 can have a section in its side facing toward the other door 10' which is marked by the reference numeral 100 and which forms the mounts for the section 26 of the seal 20 and also the mount for rotary axle 32 of the cam 30. It is also conceivable that the rotary axle 32 is a component of the door section 100 and is connected to the cam 30 or to a cut-out of the cam 30.

It is also conceivable to integrate the mount for the heater for avoiding condensate in this mount section 100.

It is also possible that the rotary axles or the mounts provided for the rotary axles are alternatively or additionally arranged at one or more cover sections which e.g. form the upper cover of the door 10.

A spring which is likewise arranged in or at the door section 100 and/or in the named cover is identified by the reference numeral 40 in FIG. 3.

This spring 40 acts on the cam 30 such that its contact region 32 is moved away from the door 10, and indeed into the position which can be seen in FIG. 3.

It is generally conceivable that two or more cams 30 are provided per door 10, 10' which engage, for example, at both ends, i.e. in an upper section of the seal 20 and in a lower section of the seal 20, into said sections or are connected thereto via the section 22, 36.

The described design of the door 10 applies accordingly to the door 10' which is not shown in FIG. 3 and which has the named components in a mirror arrangement.

FIG. 3 shows the position of the cam 30 and of the seal 20 in a state in which one or both doors are open. In this state, the contact region 34 of the cam 30 is moved away from the door 10, that is to the left in accordance with FIG. 3, by the force of the spring 40. This results in a rotation of the cam 30 clockwise and in a movement of the section 36 of the cam 30 to the right.

This movement of the cam 30 has the consequence that the door seal 20 is rotated and/or pivoted clockwise, starting from the closing position, and indeed about the pivot axis 26, until it has reached its position shown in FIG. 3. In this position, the seal 10 is located in its second position in accordance with the invention in which it is moved toward the door 10.

As was shown above, the cams 30, 30' are pushed out of the respective mount of the doors 10, 10' by the spring tension both with the opened door 10' and with the closed door 10. By the corresponding support of the cams 30, 30' in the mount parts of the section 100 and by the engagement into the mount 22 of the French door coextrusion section, the seals 10, 10' are thereby pushed into the respective parked position, that is into the second position. It is ensured by this second position that no disturbing contour is located in the region of the closed door 10 during the closing procedure of the door 10'.

This has the advantage that the respective door 10' can be closed without seal friction. Shortly before the door 10' is completely closed, the cams 30, 30' mutually touch and are pushed into the mount parts or mount regions of the doors 10, 10'. That is the cams 30, 30' mutually displace one another in this case.

If the door 10' is thus closed, starting from the position shown in FIG. 1, the contact region 34 of the cam 30 comes into contact with the cam 30', or its contact region of the other door 10' from a certain closing angle of the door 10 onward, which has the result that the cam 30 shown in FIG. 3 is pivoted counter clockwise about the axis 32. This in turn has the result that the seal 20 which is connected to the cam 30 via the elements 22, 36 is pivoted from the second position shown in FIG. 3 counterclockwise into the first position. A corresponding process takes place with both doors, i.e. with the closed door 10, and also with the door to be closed 10'.

This means that the seals 20, 20' are deflected via their pivot points 26 and move toward one another until the seals 20, 20' touch and seal the door gap.

It is conceivable that the seals have a small stroke region of +/−1 mm to avoid damage or to compensate any tolerances. It is particularly advantageous if the cam system is designed as flexible to the extent that the cams 30, 30' have a variable pivot point 32. A variable door gap can thereby be covered. It is, for example, conceivable to cover a door gap in the order of magnitude of 6-9 mm, +1 mm, stroke of the seal itself.

Figure 2:
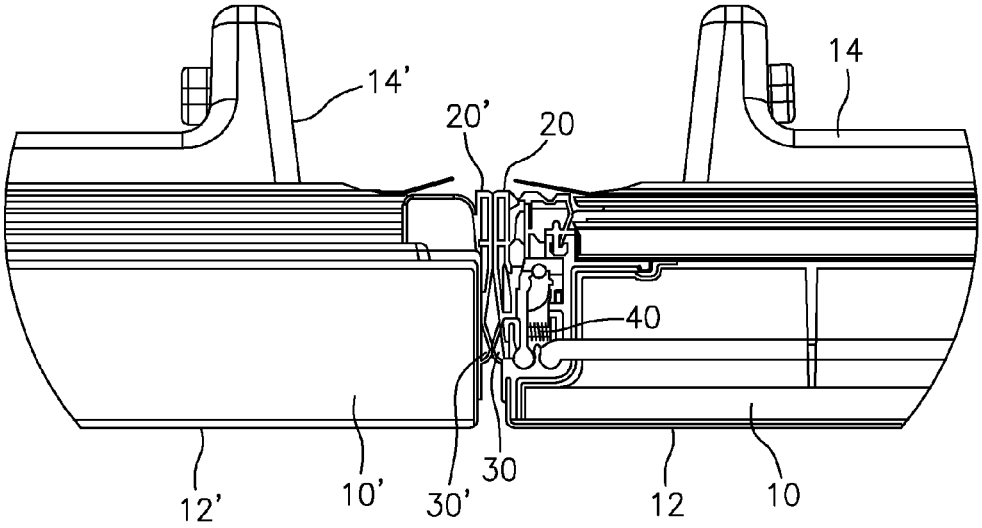
FIG. 2: a plan view of the doors in accordance with FIG. 1 in a closed state of both doors, with one door being shown in a sectional view.

FIG. 2 shows the position of the cams 30, 30' and of the seal 20, 20' in the state in which both doors 10, 10' are closed. In this state, the respective contact regions 34 of the two cams 30, 30' are connected to one another. Each of the cams 30, 30' is thus pressed in by the respective other cam 30, 30' against the force of the spring 40, i.e. is moved toward the respective door 10, 10', which has the result that the two seals 20, 20' are moved toward one another by pivoting so that a sealing connection between the doors is present. This state results, for example, from FIG. 2. The right hand door 10 is shown in section in this Figure. The lower cam 30, which is biased to the left via the spring 40 in accordance with FIG. 2, can be seen in the right hand door 10 from FIG. 2.

If one of the doors 10, 10' or if both the doors 10, 10' is/are opened, starting from FIG. 2, this has the result that the cams 30, 30' of both doors 10, 10' are moved further away from the respective door 10, 10' due to the spring force as the opening angle increases, with the cam 30 shown in FIG. 3, for example, undergoing a clockwise rotary movement. This has the result that the seal 20 is likewise moved clockwise about the axis 26. The two door seals 20, 20' are thus moved away from one another.

If thus a door is opened, its cam leaves the contact position to the other cam from a specific opening angle onward and is moved into its second position by the force of the spring. This has the result that the cam moves the seal into its second position, that is into its parked position. This does not only apply to the opened door, but also to the door which remains closed.

There can be named as advantages that the closing of a door is easily possible without a risk of collision between the seal and the counter-door. This in particular has larger advantages in the use of door closing systems. The present invention thus also relates to a refrigerator unit and/or a freezer unit having such a door closing system.

It is furthermore conceivable no longer to integrate heating cables in the seal, but rather in the mount section, whereby the assembly effort and service effort is reduced and a possible disturbing contour by the cable in the seal is omitted. A further advantage is a smaller stroke of the seal itself and a thereby reduced churning behavior of the seal, whereby the door can be opened easily.

The invention claimed is:

1. A refrigerator unit or a freezer unit having at least one carcass which bounds a refrigerated inner space, at least one first door and a second door opening in opposite directions and pivotally connected to the carcass by which the inner space can be closed, wherein the first door is designed with a first seal and the second door is designed with a second seal, with the seals being arranged in a first position which they adopt in the closed state of the doors such that they seal the region between edges of the doors that oppose each other in the closed state, the first seal of the first door is movable into a second position in which it at least regionally has a larger spacing from the second seal of the second door than in the first position of the seals, and at least one cam positioned at the region between the edges of the doors that oppose each other in the closed state is provided which is arranged such that it is moved on the opening and closing of the first door, with the cam contacting both the second door and the second seal such that it moves the first seal from its first position into its second position when the first door is opened, wherein the seal is arranged such that it is pivotable about an axis, and wherein the cam is arranged such that it is pivotable about an axis, and wherein at least one of the position of the axis about which the seal is pivotable and the position of the axis about which the cam is pivotable is variable.

2. A refrigerator unit or a freezer unit in accordance with claim 1, wherein the cam is fixedly connected to the seal and has a common pivot point.

3. A refrigerator unit or a freezer unit in accordance with claim 1, wherein the cam is located in its first position when the first door is closed and is located in its second position when the first door is open.

4. A refrigerator unit or a freezer unit in accordance with claim 3, wherein the cam and the second seal contact one another such that the cam moves the first seal from its first position into its second position when the cam is moved from its first position into its second position, and vice versa.

5. A refrigerator unit or a freezer unit in accordance with claim 3, wherein the cam is arranged such that at least in its second position it projects beyond the end face of the first door and in its second position is moved at least sectionally further away from the first door than in its first position.

6. A refrigerator unit or a freezer unit in accordance with claim 1, wherein the cam has at least one contact section at which the cam is in contact with a second cam of the second door in the closed state of the doors.

7. A refrigerator unit or a freezer unit in accordance with claim 6, wherein the axis about which the cam is pivotable is located between the contact section of the cam and the region in which the cam is in contact with the seal.

8. A refrigerator unit or a freezer unit in accordance with claim 1, wherein at least one spring is provided which exerts a force onto the cam or directly onto the seal.

9. A refrigerator unit or a freezer unit in accordance with claim 8 wherein the cam is located in its first position when the first door is closed and is located in its second position when the first door is open and the spring is arranged such that the cam is acted on by a force in the direction toward its second position.

10. A refrigerator unit or a freezer unit in accordance with claim 1, wherein the unit has at least one mechanism by which an open door is movable into a closed position.

11. A refrigerator unit or a freezer unit in accordance with claim 1, wherein the seals and cams are arranged with mirror symmetry to one another at both doors.

12. A refrigerator unit or a freezer unit in accordance with claim 1, wherein the cams of both doors are moved when one or when both of the doors is/are opened.

13. A refrigerator unit or a freezer unit in accordance with claim 1, wherein the seals of both doors are moved when one or when both of the doors is/are opened.

14. A refrigerator unit or a freezer unit in accordance with claim 1, wherein the cam is fixedly connected to the seal and has a common pivot point.

* * * * *